US007278856B2

(12) United States Patent
Minich

(10) Patent No.: US 7,278,856 B2
(45) Date of Patent: Oct. 9, 2007

(54) CONTACT PROTECTOR FOR ELECTRICAL CONNECTORS

(75) Inventor: Steven E. Minich, York, PA (US)

(73) Assignee: FCI Americas Technology, Inc., Reno, NV (US)

( * ) Notice: Subject to any disclaimer, the term of this patent is extended or adjusted under 35 U.S.C. 154(b) by 24 days.

(21) Appl. No.: 11/201,437

(22) Filed: Aug. 10, 2005

(65) Prior Publication Data

US 2006/0046526 A1 Mar. 2, 2006

Related U.S. Application Data

(60) Provisional application No. 60/605,942, filed on Aug. 31, 2004.

(51) Int. Cl.
*H01R 12/00* (2006.01)

(52) U.S. Cl. ..... 439/65; 439/484; 439/608

(58) Field of Classification Search ..... 439/484, 439/65, 79

See application file for complete search history.

(56) References Cited

U.S. PATENT DOCUMENTS

| | | | | |
|---|---|---|---|---|
| 4,197,945 | A | 4/1980 | Sherwood | 206/328 |
| 4,512,462 | A * | 4/1985 | Dills | 206/53 |
| 4,986,772 | A * | 1/1991 | Fukutani | 439/892 |
| 5,026,295 | A | 6/1991 | Fong et al. | 439/135 |
| 5,106,313 | A | 4/1992 | Lwee et al. | 439/135 |
| 5,215,474 | A | 6/1993 | Rotella | 439/149 |
| 6,146,202 | A | 11/2000 | Ramey et al. | 439/608 |
| 6,231,391 | B1 | 5/2001 | Ramey et al. | 439/608 |
| 6,371,813 | B2 * | 4/2002 | Ramey et al. | 439/608 |
| 6,783,387 | B1 | 8/2004 | Lin et al. | 439/483 |
| 6,830,457 | B1 | 12/2004 | Korsunsky et al. | 439/41 |
| 2004/0097104 | A1 | 5/2004 | Zhang | 439/41 |
| 2004/0166705 | A1 | 8/2004 | Koehler | 439/79 |
| 2004/0166739 | A1 | 8/2004 | Koehler et al. | 439/660 |
| 2006/0110968 | A1 * | 5/2006 | Miller et al. | 439/342 |

* cited by examiner

*Primary Examiner*—Briggitte R. Hammond
(74) *Attorney, Agent, or Firm*—Woodcock Washburn LLP

(57) ABSTRACT

A protective housing removably attached to an electrical connector to prevent damage to contacts of the connector during, for example, shipping or handling of the electrical connector before the connector is connected with an electrical device such as a second electrical connector. The contact protector may include a pull portion of adhesive tape that abuts a housing of the electrical connector, creating an interference fit. The contact protector may include a handle integrated with the contact protector to facilitate removal of the contact protector from the electrical connector.

46 Claims, 14 Drawing Sheets

CONTACT PROTECTOR FOR ELECTRICAL CONNECTORS

CROSS-REFERENCE TO RELATED APPLICATIONS

This application claims benefit under 35 U.S.C. § 119(e) of provisional U.S. patent application No. 60/605,942, filed Aug. 31, 2004, entitled "Mating Pin Protection Methods," the disclosure of which is incorporated herein by reference in its entirety.

FIELD OF THE INVENTION

Generally, the invention relates to electrical connectors. More particularly, the invention relates to methods for protecting electrical connector electrical contacts during shipment, handling, processing, and pre-mating of the electrical contacts.

BACKGROUND OF THE INVENTION

A male, plug, or header electrical connector typically includes an arrangement of electrical contacts or mating pins. The electrical contacts may extend beyond a housing of the connector or a frame of a lead frame assembly and thus are partially exposed. Sometimes, during handling or shipment of the electrical connector, exposed end portions of the electrical contacts bend. Consequently, during mating, the bent contacts do not match up with the, for example, corresponding receptacle connector contacts. The electrical connector, therefore, may not properly connect with receptacle connector contacts. That is, not all electrical contacts of the electrical connector will engage properly into the complementary contacts of the receptacle connector. Additionally, when a connector with bent electrical contacts is attempted to be mated, the pins may be bent further as they abut the receptacle connector and pressure is applied. Moreover, in many cases, a damaged electrical connector can ruin an entire motherboard or daughtercard. Thus, there is a need in the art for a mechanism that tends to prevent bending and misalignment of the electrical contacts during handling and shipment of the electrical connector.

SUMMARY OF THE INVENTION

A contact protector for an electrical header connector assembly is disclosed. The contact protector may include a mating side that mimics a mating side of a receptacle connector that is complementary to the header connector assembly. Such a housing may be inserted into the header connector assembly to protect the mating pins during shipment. The contact protector may include a pull portion, which may be, for example, a handle attached to the contact protector or a piece of tape taped to the contact protector, so that the user can remove the contact protector from the header connector assembly.

DETAILED DESCRIPTION OF ILLUSTRATIVE EMBODIMENTS

Figure 1:
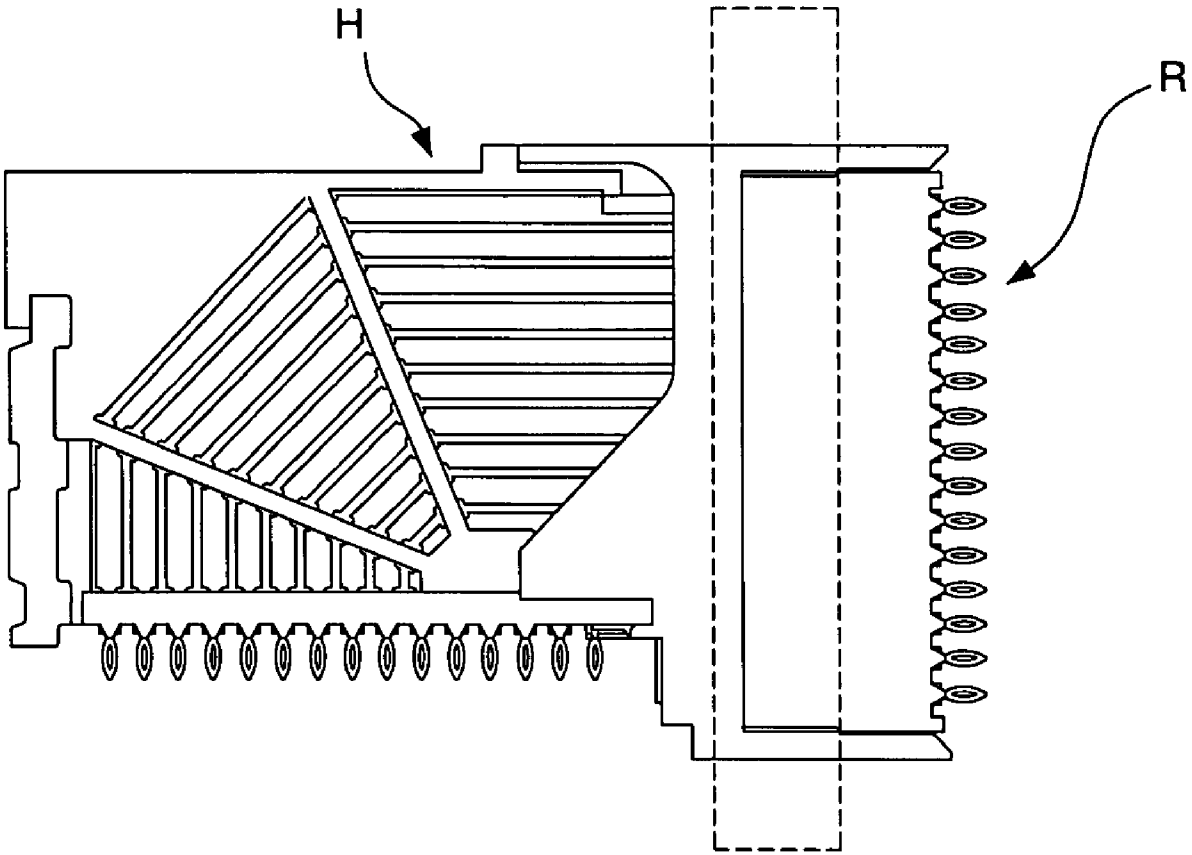
FIG. 1 generally depicts a header connector assembly engaged with a receptacle connector.

FIG. 1 generally depicts a header connector assembly H engaged with a receptacle connector R. A mating interface area is designated generally with the reference I and refers to the mating interface between the header connector assembly H and the receptacle connector R.

Figure 2A:
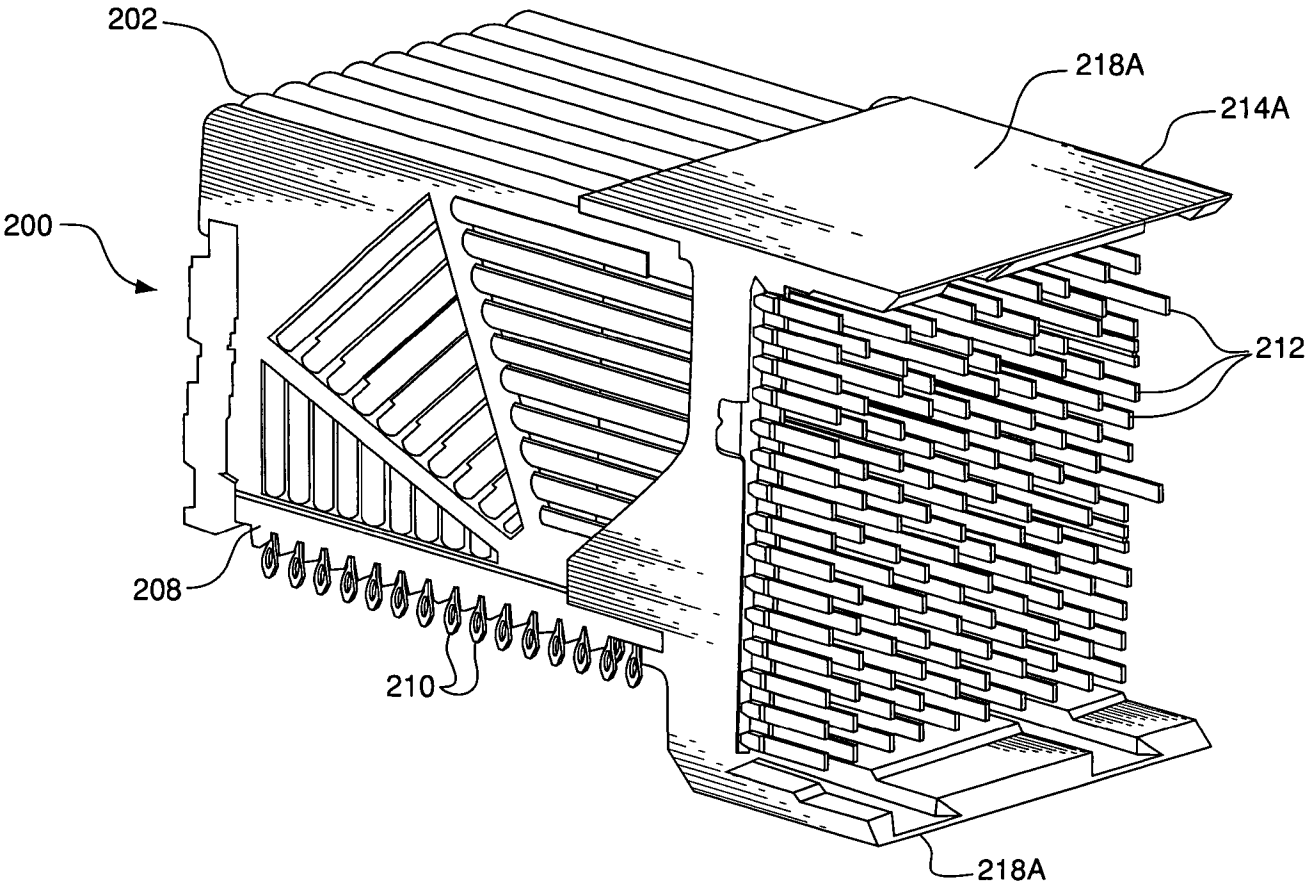
FIGS. 2A and 2B depict alternative example embodiments of a header connector assembly.
Figure 2B:
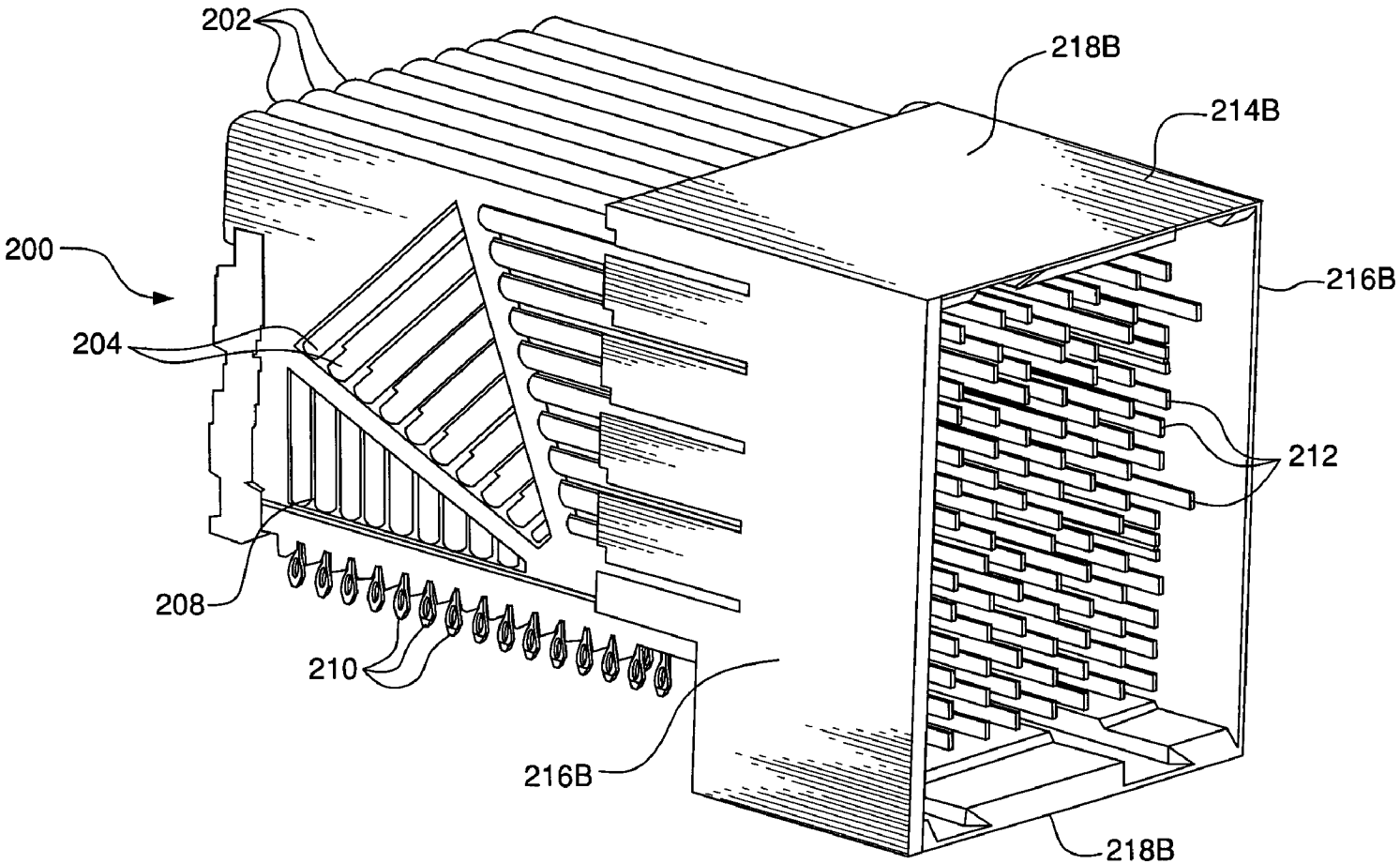
Figure 3A:
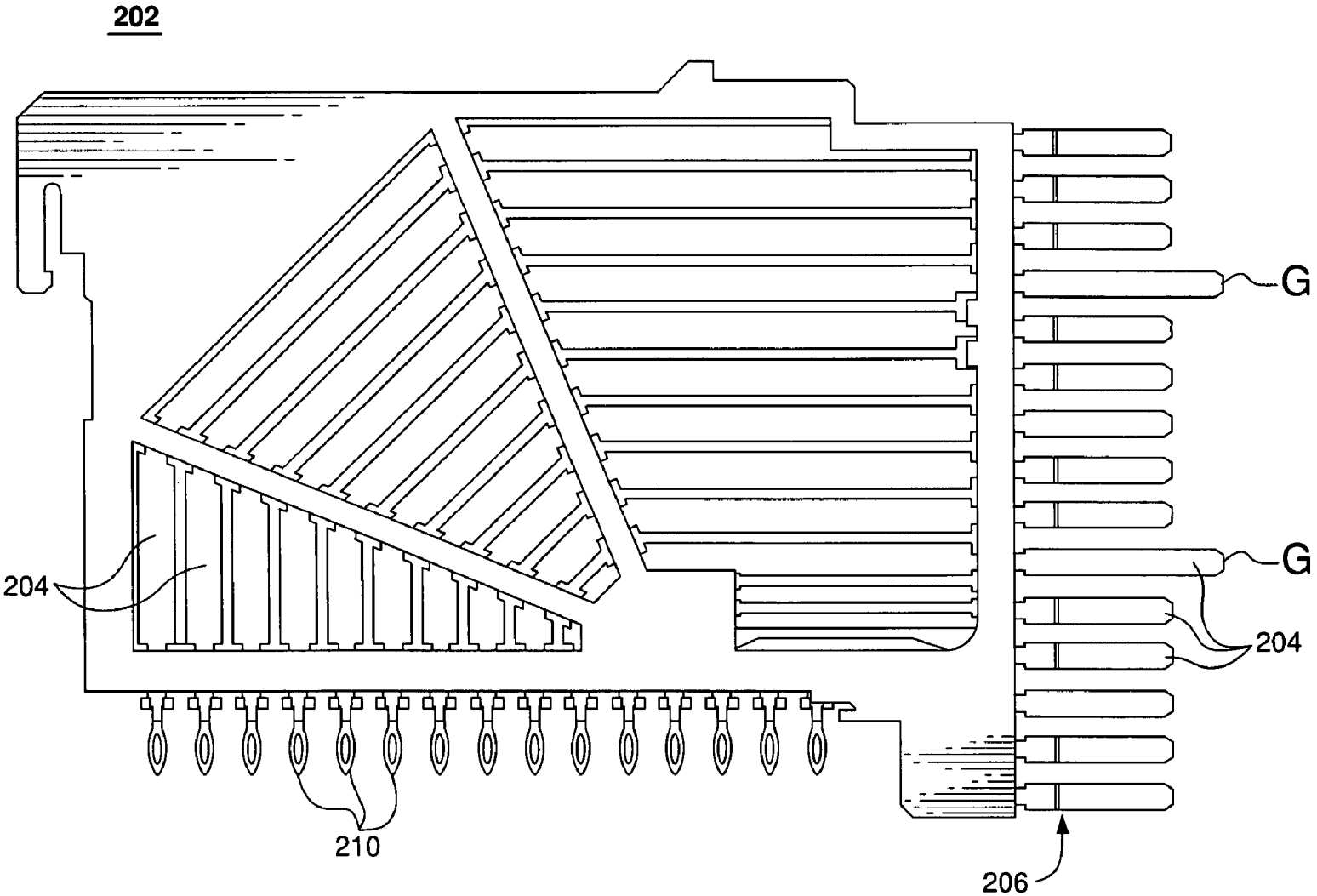
FIGS. 3A and 3B are side views of alternative example embodiments of an insert molded leadframe assembly (IMLA).
Figure 3B:
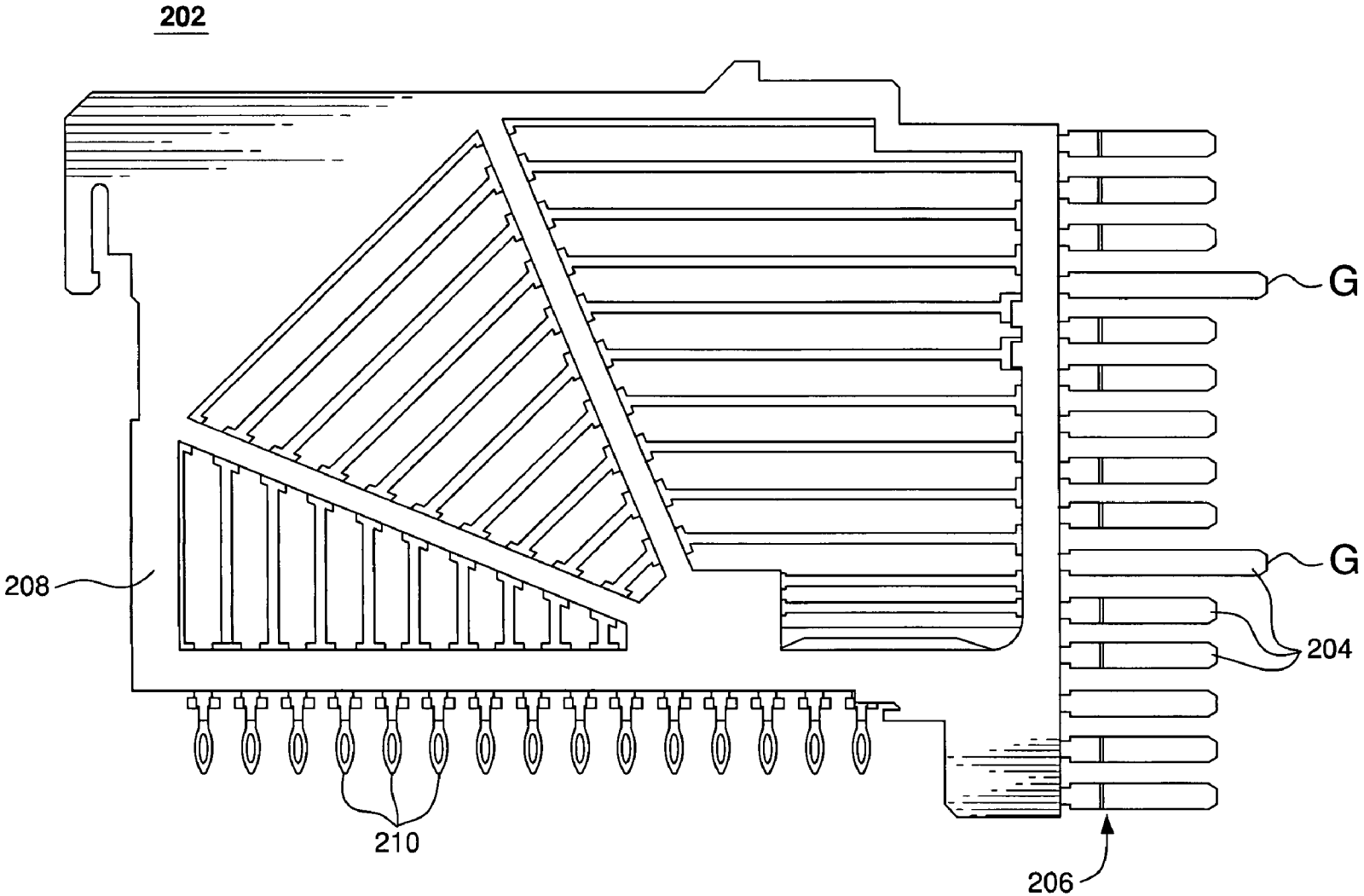

FIGS. 2A and 2B depict example embodiments of a header connector assembly. As shown, the header connector assembly 200 may include a plurality of insert molded leadframe assemblies (IMLAs) 202. FIGS. 3A and 3B are side views of example embodiments of an IMLA 202 according to the invention. An IMLA 202 includes a contact set 206 of electrically conductive contacts 204, and an IMLA frame 208 through which the contacts 204 at least partially extend. An IMLA 202 may be used, without modification, for single-ended signaling, differential signaling, or a combination of single-ended signaling and differential signaling. Each contact 204 may be selectively designated as a ground contact, a single-ended signal conductor, or one of a differential signal pair of signal conductors. The contacts designated G may be ground contacts, the terminal ends of which may be extended beyond the terminal ends of the other contacts. Thus, the ground contacts G may mate with complementary receptacle contacts before any of the signal contacts mates.

As shown, the IMLAs 202 are arranged such that contact sets 206 form contact columns, though it should be understood that the IMLAs 202 could be arranged such that the contact sets are contact rows. Also, though the header connector assembly 200 is depicted with 150 contacts (i.e., 10 IMLAs with 15 contacts per IMLA), it should be understood that an IMLA 202 may include any desired number of contacts and a connector may include any number of IMLAs 202. For example, IMLAs 202 having 12 or 9 electrical contacts are also contemplated. A connector according to the invention, therefore, may include any number of contacts. Moreover, the header connector assembly 200 may also be a vertical or mezzanine type of connector instead of a right angle header.

The header connector assembly 200 may include an electrically insulating IMLA frame 208 through which the contacts extend. Preferably, each IMLA frame 208 is made of a dielectric material such as a plastic. According to an aspect of the invention, the IMLA frame 208 is constructed from as little material as possible. Otherwise, the connector is air-filled. That is, the contacts may be insulated from one another using air as a second dielectric. The use of air provides a low-weight connector (as compared to a connector that uses a heavier dielectric material throughout).

The contacts 204 include terminal ends 210 for engagement with a circuit board, such as a standard PCB. Preferably, the terminal ends are compliant terminal ends, though it should be understood that the terminals ends could be surface-mount (such as BGA) or through-mount terminal ends. The contacts also include mating ends 212 for engagement with complementary receptacle contacts (described below in connection with FIGS. 4A and 4B).

As shown in FIG. 2A, the housing 214A includes first and second walls 218A. FIG. 2B depicts a header connector assembly 200 with a housing 214B that includes a first pair of end walls 216B and a second pair of walls 218B.

The header connector assembly 200 may be devoid of any internal shielding. That is, the header connector assembly 200 may be devoid of any shield plates, for example, between adjacent contact sets. A connector according to the invention may be devoid of such internal shielding even for high-speed, high-frequency, fast rise-time signaling.

Though the header connector assembly 200 depicted in FIGS. 2A and 2B is shown as a right-angle connector, it should be understood that a connector according to the invention may be any style connector, such as a mezzanine connector, for example. That is, an appropriate header connector assembly may be designed according to the principles of the invention for any type connector.

Figures 4A, 4B:
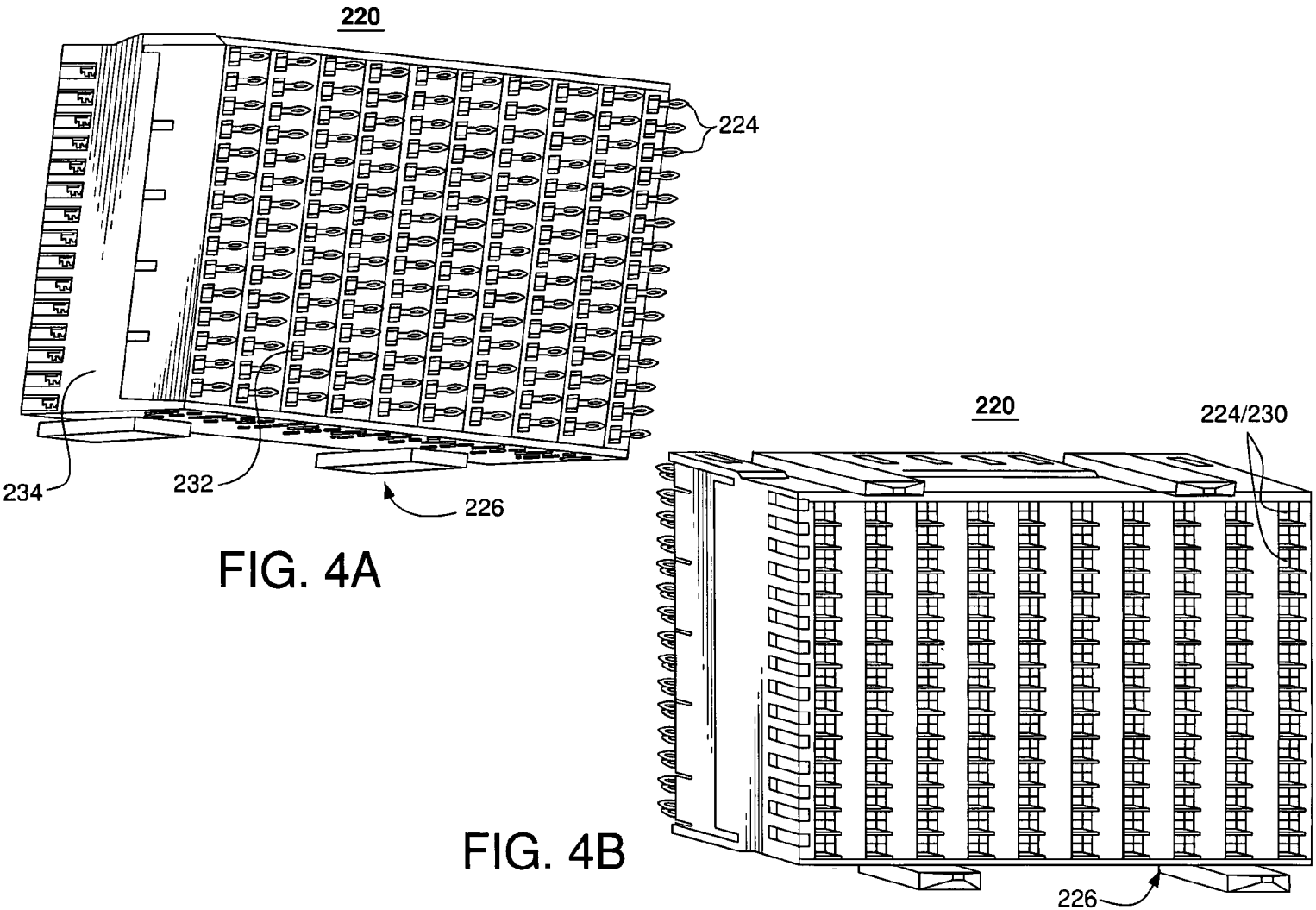
FIGS. 4A and 4B depict an example embodiment of a receptacle connector.

FIGS. 4A and 4B depict an example embodiment of a receptacle connector 220. The receptacle connector 220 includes a plurality of receptacle contacts 224, each of which is adapted to receive a respective mating end 212. Further, the receptacle contacts 224 are in an arrangement that is complementary to the arrangement of the mating ends 212 of the header connector assembly 200. Thus, the mating ends 212 may be received by the receptacle contacts 224 upon mating of the assemblies. Preferably, to complement the arrangement of the mating ends 212, the receptacle contacts 224 are arranged to form contact sets 226. Again, though the receptacle connector 220 is depicted with 150 contacts (i.e., 15 contacts per column), it should be understood that a connector according to the invention may include any number of contacts.

Each receptacle contact 224 has a mating end 230, for receiving a mating end 212 of a complementary header contact 204, and a terminal end 232 for engagement with a circuit board. Preferably, the terminal ends 232 are compliant terminal ends, though it should be understood that the terminals ends could be press-fit, balls, or any surface-mount or through-mount terminal ends. A housing 234 is also preferably provided to position and retain the IMLAs relative to one another. Stitched contacts can also be used.

Figure 5B:
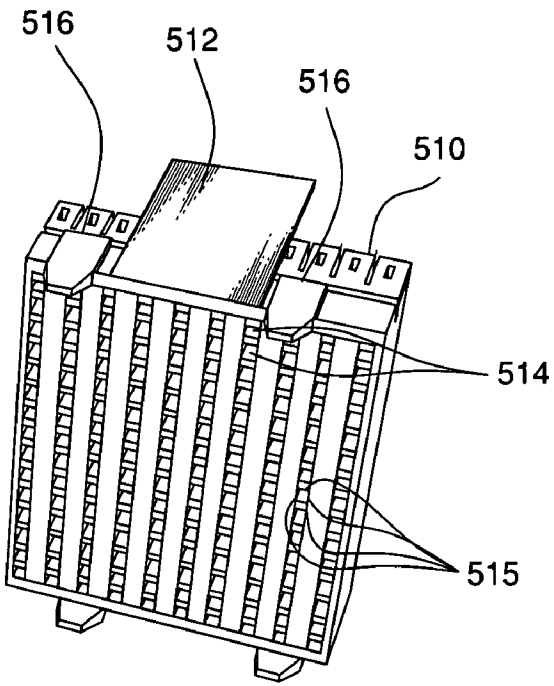
FIG. 5B shows an example embodiment of a contact protector according to the invention.
Figure 5A:
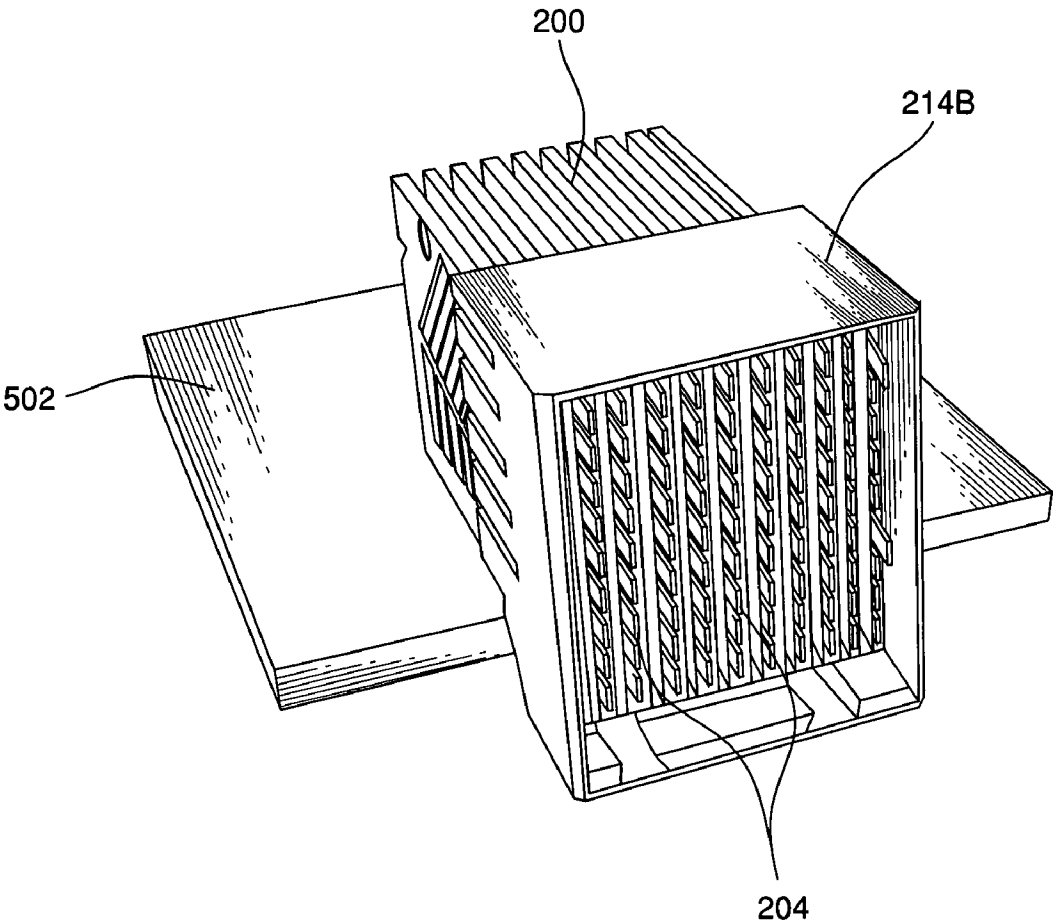
FIG. 5A shows a right-angle header connector assembly mounted to a test card.

FIG. 5A depicts an example embodiment of the header connector assembly 200, as described above, mounted to a test card 502. Though the mating pins 204 may be partially protected by the housing 214B, the possibility of pin damage due to improper handling may still be a concern.

FIG. 5B shows an example embodiment of a contact protector 510 according to the invention, which, as shown, may be a mating receptacle housing that has not been equipped with any electrical contacts. A friction fit between the mating pins 204 of the header connector assembly 200 and corresponding mating contacts (reference 232 in FIG. 4A) on the mating receptacle housing may keep the header and receptacle coupled together. However, the present invention replaces the receptacle contacts with a pull portion 512, e.g., a piece of adhesive tape, applied to one side of the contact protector 510. According to an aspect of the invention, the contact protector 510 may be easily inserted into and removed from the header connector assembly 200. The thickness of the pull portion 512 may be chosen such that it will cause interference between the header connector assembly 200 and the contact protector 510 when the contact protector 510 is mated with the header connector assembly 200. Such interference may retain the contact protector 510 during handling and shipping, for example. The pull portion 512 may be flexible and deflect when parts are inserted into tubes or other packaging materials.

As shown, the contact protector 510 may define a plurality of apertures 514, each of which corresponds to a respective mating pin 204 of the header connector assembly 200. Thus, the contact protector 510 may have a plurality of walls 515 that define the individual apertures 514 and tend to prevent bending and misalignment of the mating pins 204.

Alternatively, the contact protector 510 may define a plurality of apertures, each of which corresponds to a respective plurality of mating pins 204. For example, the contact protector 510 may define a respective aperture for each column of mating pins 204. In such an embodiment, each aperture would extend along the contact protector 510 such that, when the contact protector 510 is inserted into the header connector assembly 200, the corresponding contact column is protected within the extended aperture. Preferably, the contact protector 510 is symmetric such that it can be inserted into the header connector assembly 200 assembly in either orientation, that is, with the pull portion 512 at the top or the bottom of the header connector assembly 200.

The contact protector 510 may include a plurality of guides 516 extending along the direction of the contact columns. Preferably, the guides 516 provide rough alignment for mating connectors.

The thickness of the contact protector 510 may be chosen such that, when the contact protector 510 is fully inserted into the header connector assembly 200, the contact protector 510 does not extend past any outside surfaces of the header connector assembly 200. Further, the thickness of the contact protector may be chosen such that, when the contact protector is fully inserted into the header connector assembly 200, none of the contacts 204 extend beyond the contact protector 510.

Figure 6:
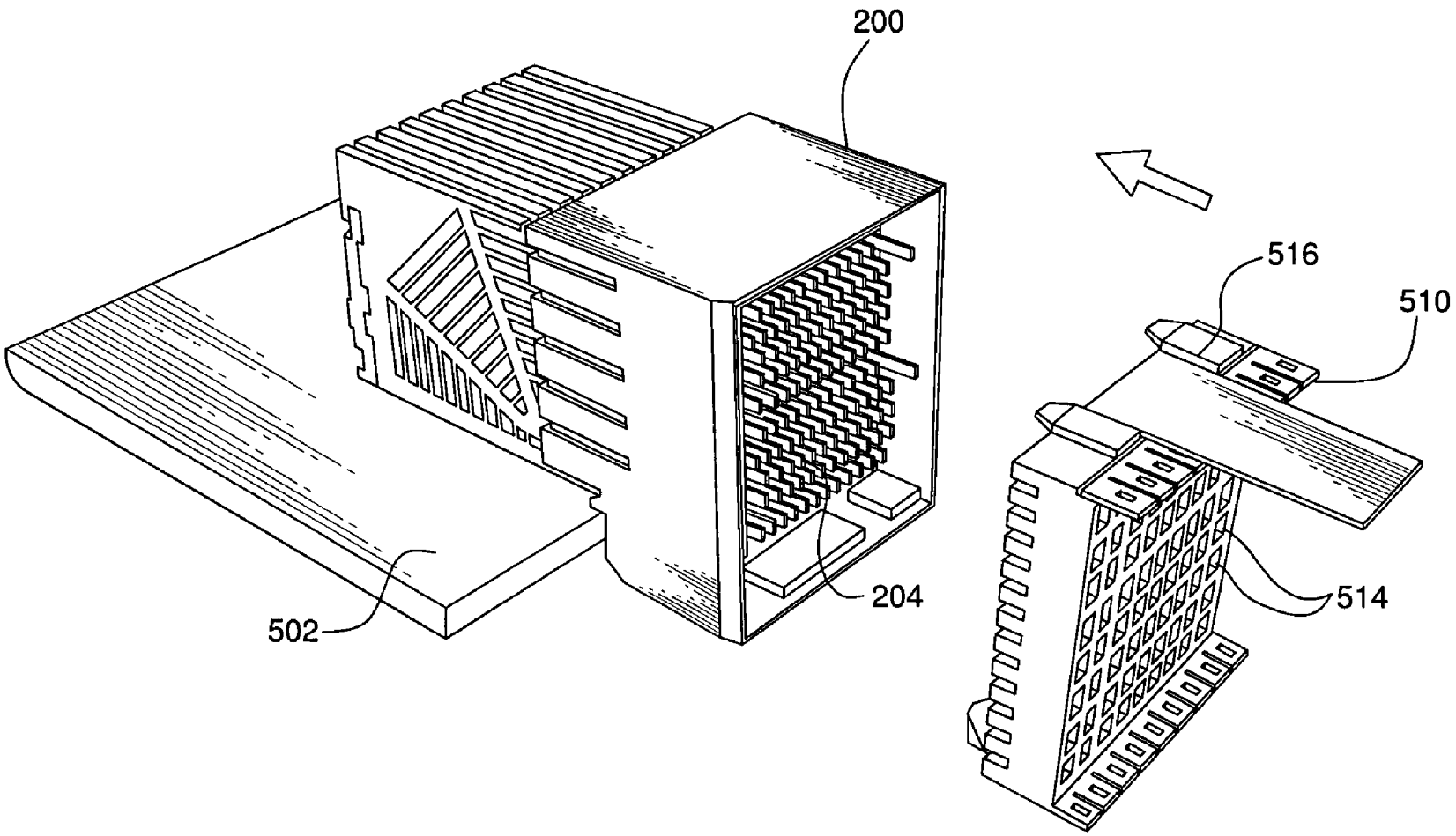
FIG. 6 shows the example contact protector of FIG. 5B positioned for insertion into the header connector assembly of FIG. 5A.

FIG. 6 shows the contact protector 510 during insertion into the header connector assembly 200. The contact protector 510 may be inserted into the header connector assembly 200 along a direction indicated by the arrow.

Figure 7:
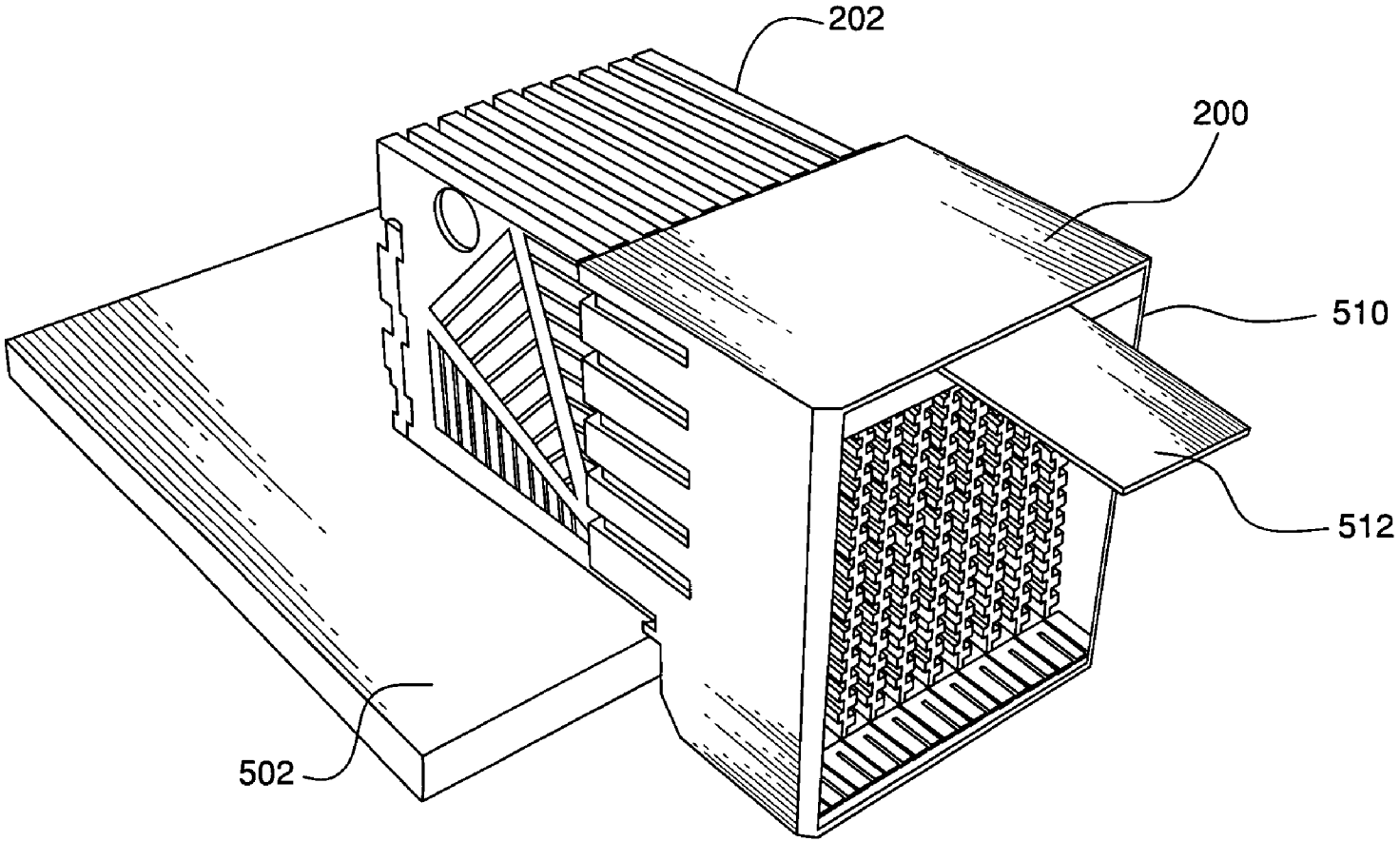
FIG. 7 shows the example contact protector of FIG. 5B fully inserted into the header connector assembly of FIG. 5A.

FIG. 7 shows the contact protector 510 fully inserted into the header connector assembly 200. As shown, the header mating pins may be fully protected by the contact protector 510 to prevent damage during handling. The pull portion 512 can be pulled to remove the contact protector 510 from the connector assembly 200. Also, the pull portion 512 acts as a flag, indicating to the end user that the contact protector 510 should be removed prior to, for example, daughter card insertion into a backplane.

Prior to shipping, the contact protector 510 may be removed so that tests of the header connector assembly 200 may be performed by, for example, mating the daughter card to a test device. After the system test has been completed, the contact protector 510 may be reinstalled onto the header connector assembly 200. Re-installation of the contact protector 510 may ensure that pins 204 have not been damaged while the contact protector 510 was removed. Thus, the contact protector 510 may function as a gauge prior to shipping the final header connector assembly 200, indicating whether any of the mating pins 204 have been bent or damaged.

Figure 8A:
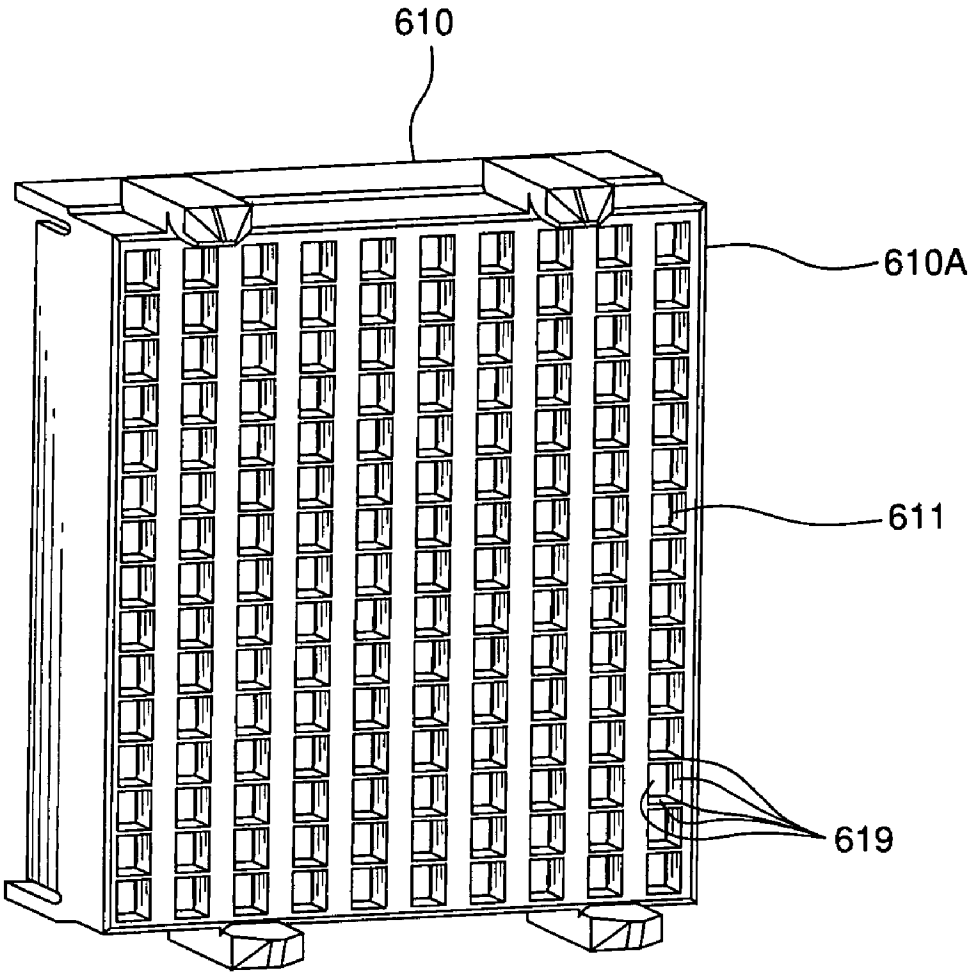
FIGS. 8A and 8B depict an alternative example embodiment of a contact protector according to the invention.
Figure 8B:
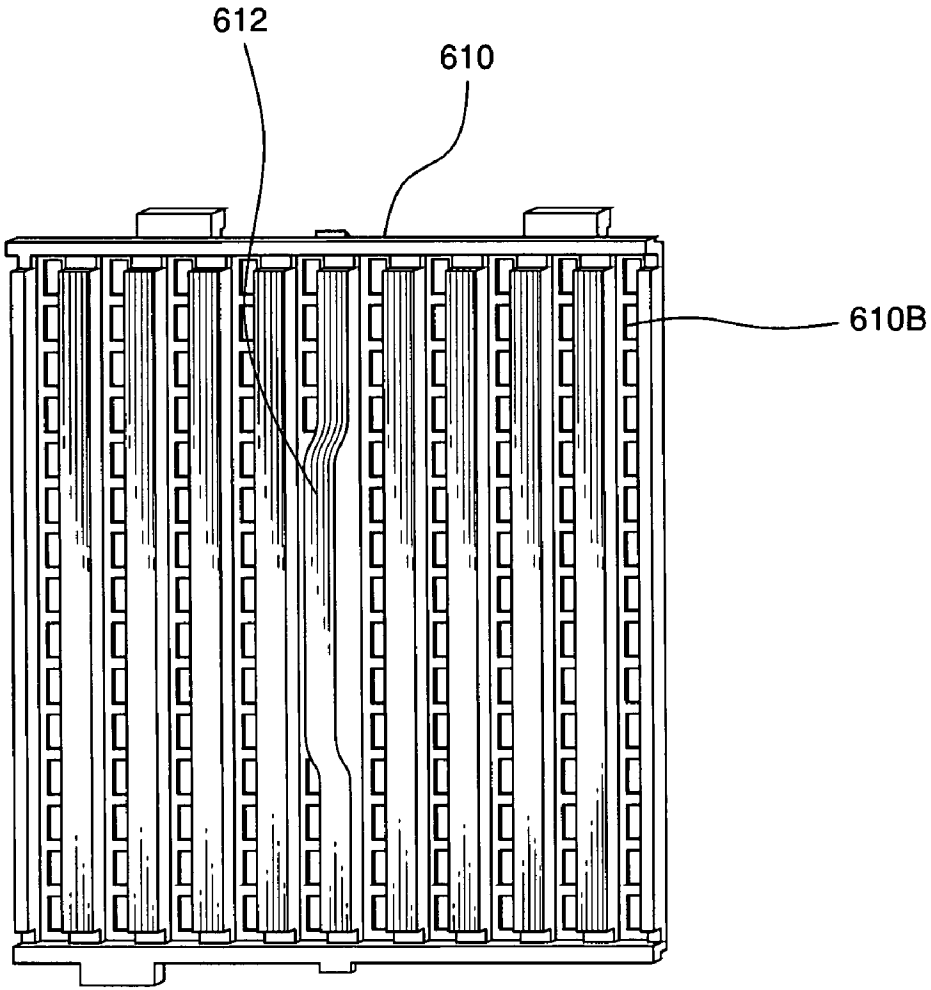

FIGS. 8A and 8B depict an example embodiment of a contact protector 610 according to the invention. As shown in FIG. 8A, the mating side 610A of the contact protector 610 may mimic the mating side of the housing of the receptacle connector 220 (as shown in FIG. 4B) that is designed to mate with the header connector assembly 200. It should be understood, therefore, that the contact protector 610 according to the invention need not require any additional design engineering resources or mold tooling. The concept can be used with any existing assembly because the housing of the mating receptacle connector 220 will already be tooled. The cost of such a housing thus could be minimal, and may therefore be shipped using existing header packaging tubes.

As shown, the contact protector 610 may define a plurality of apertures 611, each of which corresponds to a respective mating pin 204 of the header connector assembly 200. Thus, the contact protector 610 may have a plurality of walls 619 that define the individual apertures 611 and tend to prevent bending and misalignment of the mating pins 204.

FIG. 8B depicts an example embodiment of a non-mating side 610B of a contact protector 610 according to the invention. As shown, the contact protector 610 may include a pull portion 612 such as a handle that extends from the non-mating side 610B of the contact protector 610. The handle may be molded with the contact protector 610 as a single piece of plastic, or otherwise may be affixed to the non-mating side 610B of the contact protector 610 via, for example, press-fit pegs. The handle may be fixedly attached to the contact protector 610, or it may be pivotally attached to the contact protector 610. In addition, the handle may include a solid flat portion that can receive a pick and place device, such as a suction cup. In this latter case, the individual apertures 611 shown in FIG. 8A are still intact.

Figure 9:
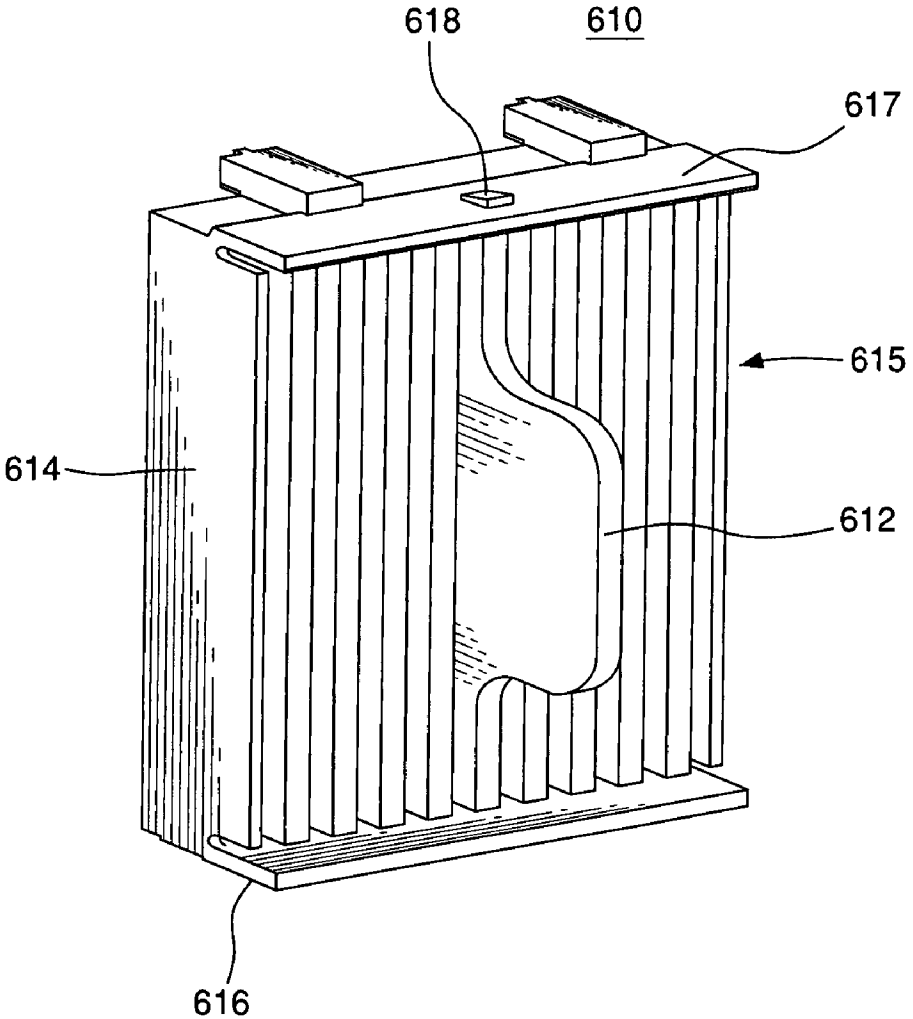
FIG. 9 depicts a perspective view of the example contact protector of FIGS. 8A and 8B.

FIG. 9 depicts a perspective view of the contact protector 610, according to the invention. As shown in FIG. 9, the contact protector may include one or more ramps 618 as part of or affixed to a contact protector side wall 617 above the pull portion 612. Such a ramp may be located on other sides 614, 615, 616 of the contact protector 610. The ramps 618 may provide interference with inside surfaces of the header connector assembly 200 housing. The ramps 618 may work with header connector assemblies 200 with or without end walls, as shown in FIGS. 2B and 2A, respectively. The housing 214 of the header connector assembly 200 may include one or more resilient beam members extending along one or more sides. The ramps 618 of the contact protector 610 may be disposed such that, when the contact protector 610 is inserted into the header connector assembly 200, the ramps 618 cause one or more of the first pair of end walls 216B and/or the second pair of walls 218B of the header connector assembly 200 to deflect. Alternatively, the ramps 618 themselves may be resilient and may deflect upon insertion of the contact protector 610 into the header connector assembly 200. Another option includes the provision of windows in the header 200 in a mating region, wherein the ramps 618 latch into the windows.

Figure 10:
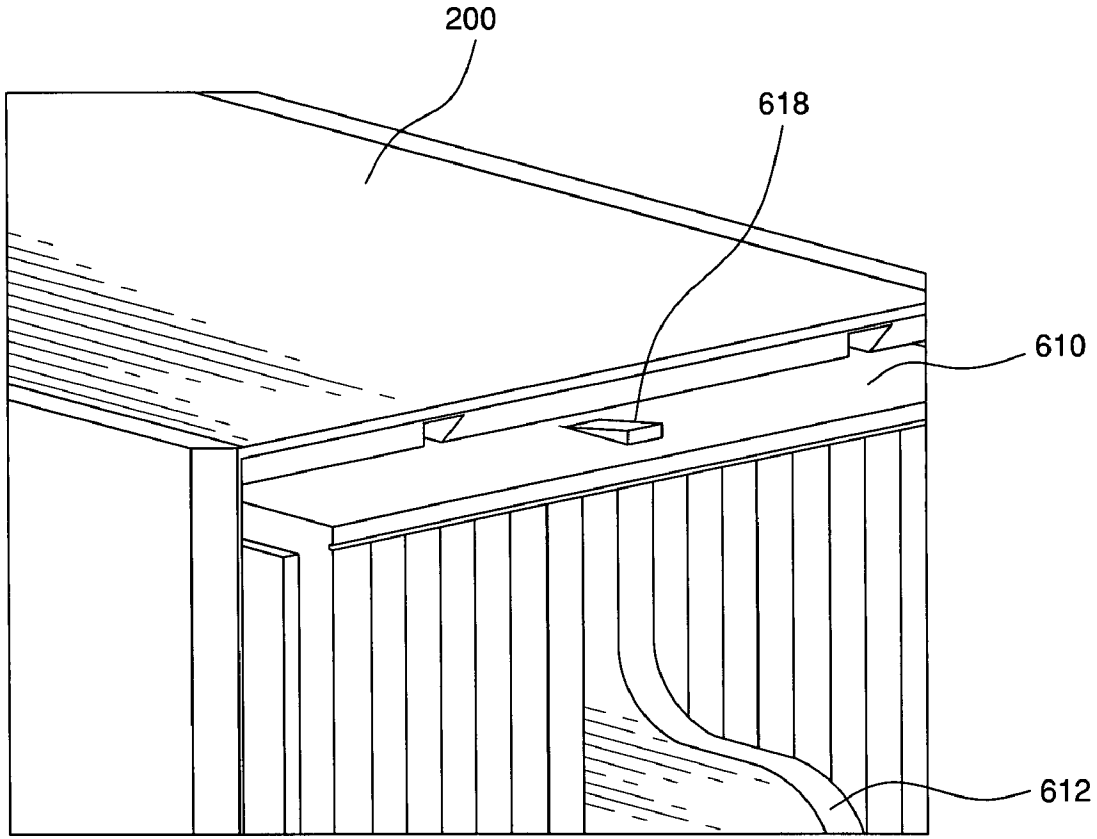
FIG. 10 depicts a detailed, partial view of the example contact protector of FIG. 9, partially inserted into a header connector assembly.

FIG. 10 depicts a detailed, partial view of a contact protector 610 partially inserted into a header connector assembly 200. As shown, the ramp 618, which also functions as a latch, is not engaged. When the contact protector 610 is fully inserted into the header connector assembly 200, the latch ramp 618 may engage an inner lip of the housing of the header connector assembly 200. Such engagement tends to prevent the contact protector 610 from inadvertently moving out of the header connector assembly 200. Alternatively, an interference fit between the ramps 618 (discussed above) and the housing of the header connector assembly 200 is also contemplated.

Figure 11:
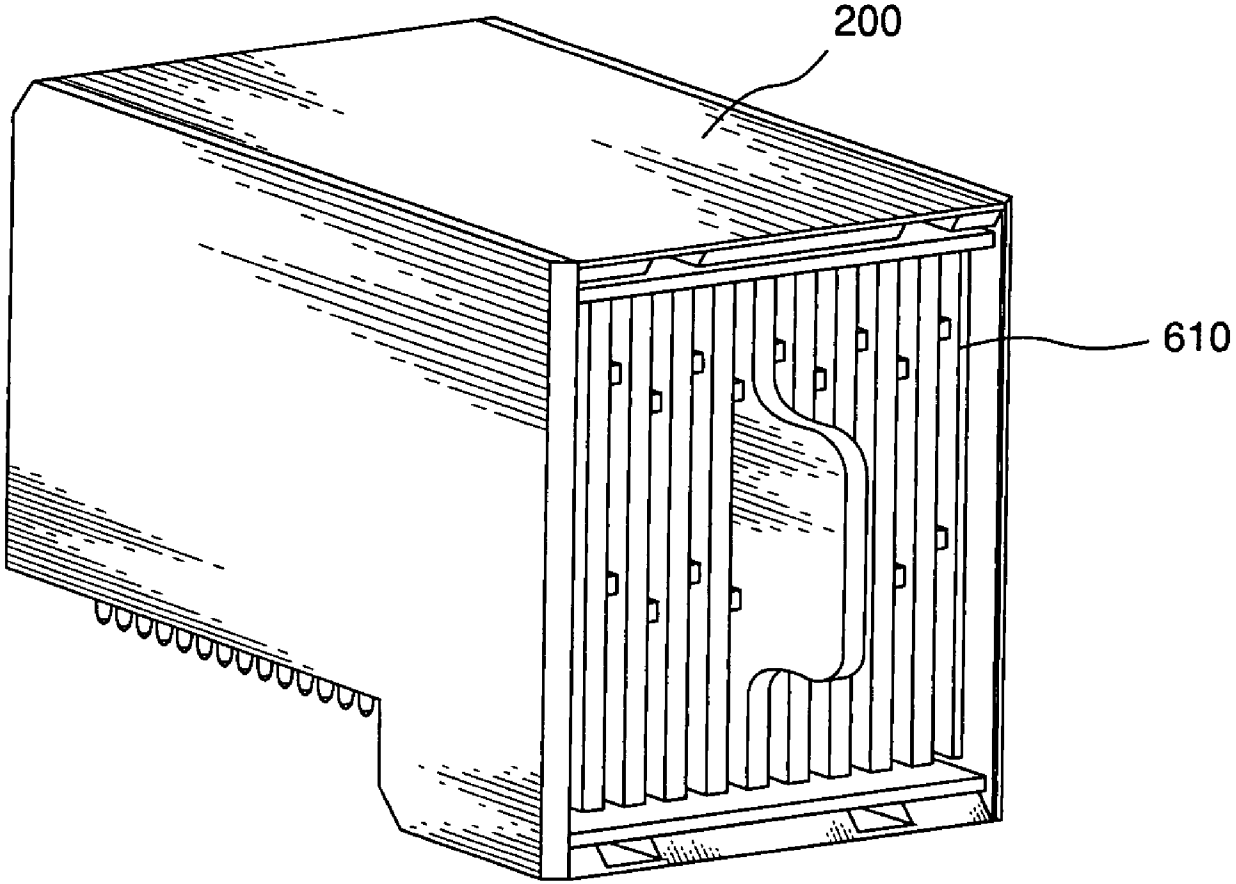
FIG. 11 depicts a perspective view of the example contact protector of FIG. 9 fully inserted into a header connector assembly.

FIG. 11 depicts a contact protector 610 fully inserted into a header connector assembly 200. As shown, the thickness of the contact protector 610 may be chosen such that even the long ground G mating pins 204 of the header connector assembly 200 are recessed within the contact protector 610. That is, the thickness of the contact protector 610 may be chosen such that none of the mating pins 204 extends beyond the contact protector 610. Preferably, the longest mating pins may be recessed about 0.1 to 1.0 mm, with 0.3 mm preferred, from the outer face of the contact protector 610.

It is to be understood that the foregoing illustrative embodiments have been provided merely for the purpose of explanation and are in no way to be construed as limiting of the invention. Words which have been used herein are words of description and illustration, rather than words of limitation. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. For example, it will be recognized and understood that a contact protector according to the invention may be used to protect the mating end of contacts (i.e., the end of contacts that mate with an electrical connector). Additionally, a contact protector according to the invention may be used to protect respective terminal ends of contacts, that is, the end of contacts that electrically connect to a substrate such as a printed circuit board.

Those skilled in the art, having the benefit of the teachings of this specification, may affect numerous modifications thereto and changes may be made without departing from the scope and spirit of the invention in its aspects.

What is claimed is:

1. An electrical connector comprising:

a connector assembly housing defining an interior region and having a mating interface for electrical connection of the electrical connector to a mating interface of an electrical device;

a contact protector comprising a body portion having a mating side and a non-mating side opposite the mating side, said body portion at least partially received into the interior region defined by the connector assembly housing, and said body portion defining an aperture that extends through the body portion from the mating side to the non-mating side;

an electrical contact for electrically connecting the electrical connector to the electrical device, the electrical contact comprising an end extending into the aperture, wherein the contact protector is adapted to be removed from the connector assembly housing prior to electrically connecting the electrical contact to the electrical device; and an interference ramp attached to a side wall of the contact protector, wherein a first end of the interference ramp abuts the connector assembly housing and a second end is positioned farther away from the side wall than the first end and an interference fit is created between the side wall and the interference ramp when the contact protector is at least partially received in the connector assembly housing.

2. The electrical connector of claim 1, wherein the side wall is resilient.

3. The electrical connector of claim 1, wherein the body portion is entirely of an electrically insulating material.

4. The electrical connector of claim 1 wherein the interference ramp comprises a wedge that engages an opening within the connector assembly housing when the when the contact protector is received in the connector assembly housing.

5. The electrical connector of claim 1 wherein the interference ramp comprises a protrusion that engages an opening within the connector assembly housing when the when the contact protector is at least partially received in the connector assembly housing.

6. The electrical connector as claimed in claim 1, wherein the interference ramp is resilient.

7. The electrical connector of claim 6, wherein the side wall defines a window and the interference ramp is received in the window.

8. The electrical connector as claimed in claim 1, further comprising a pull portion connected to the contact protector.

9. The electrical connector of claim 8, wherein the pull portion is adhesive tape.

10. The electrical connector of claim 8, wherein the pull portion is removable.

11. The electrical connector of claim 1, wherein the mating side of the contact protector mimics the mating interface of the electrical device.

12. The electrical connector of claim 11, wherein the electrical device is an electrical connector.

13. The electrical connector of claim 11, wherein the electrical device is a substrate.

14. A contact protector for an electrical connector, said electrical connector comprising a connector assembly housing and an arrangement of electrical contacts, said connector assembly housing comprising a wall and defining an interior region, each of said electrical contacts having a mating end that extends into the interior region, said contact protector comprising:

a body portion having a mating side and a non-mating side opposite the mating side, said body portion being adapted to be at least partially received into the interior region, said body portion defining an arrangement of apertures, each of said apertures extending through the body portion from the mating side to the non-mating side and positioned to receive a corresponding one of said electrical contacts when the body portion is received into the interior region; and a tab portion extending from the body portion such that the tab portion is externally accessible when the body portion is received into the interior region, wherein the tab portion is adapted to create an interference fit between the wall of the connector assembly housing and the body portion of the contact protector when the body portion of the contact protector is received into the interior region.

15. The contact protector of claim 14, wherein the tab portion extends from the non-mating side of the body portion.

16. The electrical connector of claim 14 further comprising a wedge extending from the body portion, the wedge engaging an opening within the connector assembly housing when the when the contact protector is received in the connector assembly housing.

17. The electrical connector of claim 14 further comprising a protrusion extending from the body portion, the protrusion engaging an opening within the connector assembly housing when the when the contact protector is received in the connector assembly housing.

18. A contact protector for an electrical connector, said electrical connector comprising a connector assembly housing and having a mating interface for electrical connection of the connector to a mating interface of an electrical device, said contact protector comprising:

a body portion having a mating side and a non-mating side opposite the mating side, said mating side having a configuration that mimics the mating interface of the electrical device, said body portion being adapted to be mated with the connector assembly housing, wherein the mating side of the body portion is made entirely of an electrically insulative material, said body portion defining an aperture that extends through the body portion from the mating side to the non-mating side; and an interference ramp attached to a side wall of the contact protector, the interference ramp abutting the connector assembly housing, creating an interference fit when the contact protector is at least partially received in the connector assembly housing.

19. The electrical connector of claim 18 wherein the interference ramp comprises a wedge that engages an opening within the connector assembly housing when the when the contact protector is received in the connector assembly housing.

20. The electrical connector of claim 18 wherein the interference ramp comprises a protrusion that engages an opening within the connector assembly housing when the when the contact protector is at least partially received in the connector assembly housing.

21. The contact protector of claim 18 further comprising a tab portion extending from the body portion such that the tab portion is externally accessible when the body portion is mated with the connector assembly housing.

22. The contact protector of claim 21, wherein the tab portion includes a handle that extends from, and is integrally formed as a single piece with, the non-mating side of the body portion.

23. An electrical connector comprising:

a connector assembly housing defining an interior region and having a mating interface for electrical connection of the electrical connector to a mating interface of an electrical device;

a contact protector comprising a body portion having a mating side and a non-mating side opposite the mating side, said body portion at least partially received into the interior region defined by the connector assembly housing, and said mating side defining an aperture, the aperture extending through the body portion from the mating side to the non-mating side;

an electrical contact for electrically connecting the electrical connector to the electrical device, the electrical contact comprising an end extending into the aperture, wherein the contact protector is adapted to be removed from the connector assembly housing prior to electrically connecting the electrical contact to the electrical device; and a pull portion connected to the contact protector, wherein the pull portion abuts the connector assembly housing, creating an interference fit when the contact protector is at least partially received in the connector assembly housing.

24. The electrical connector of claim 23, wherein the pull portion is removable.

25. The electrical connector of claim 23, wherein the body portion is entirely of an electrically insulating material.

26. The electrical connector of claim 23, wherein said aperture extends from the mating side to the non-mating side.

27. The electrical connector as claimed in claim 23, wherein the pull portion is a handle.

28. The electrical connector of claim 27, wherein the handle is injection molded onto the contact protector.

29. The electrical connector of claim 23, wherein the pull portion is an adhesive element.

30. The electrical connector of claim 29, wherein the adhesive element is adhesive tape.

31. The electrical connector of claim 23, further comprising:

an interference ramp attached to a side wall of the contact protector, the interference ramp abutting the connector assembly housing, creating an interference fit when the contact protector is at least partially received in the connector assembly housing.

32. The electrical connector of claim 31, wherein the interference ramp comprises a latch that engages an inner lip of the connector assembly housing.

33. The electrical connector of claim 23, wherein the mating side of the contact protector mimics the mating interface of the electrical device.

34. The electrical connector of claim 33, wherein the electrical device is an electrical connector.

35. The electrical connector of claim 33, wherein the electrical device is a substrate.

36. An electrical connector comprising:

a connector assembly housing defining an interior region and having a mating interface for electrical connection of the electrical connector to a mating interface of an electrical device;

a contact protector comprising a body portion having a mating side and a non-mating side opposite the mating side, said body portion at least partially received into the interior region defined by the connector assembly housing, and said mating side defining an aperture, the aperture extending through the body portion from the mating side to the non-mating side;

an electrical contact for electrically connecting the electrical connector to the electrical device, the electrical contact comprising an end extending into the aperture, wherein the contact protector is adapted to be removed from the connector assembly housing prior to electrically connecting the electrical contact to the electrical device; and an interference ramp attached to a side wall of the contact protector, the interference ramp abutting the connector assembly housing, creating an interference fit when the contact protector is at least partially received in the connector assembly housing, wherein the ramp comprises a latch that engages an inner lip of the connector assembly housing.

37. The electrical connector of claim 36, wherein the body portion is entirely of an electrically insulating material.

38. The electrical connector as claimed in claim 36, further comprising a pull portion connected to the contact protector.

39. The electrical connector of claim 38, wherein the pull portion is removable.

40. The electrical connector as claimed in claim 38, wherein the pull portion is a handle.

41. The electrical connector of claim 40, wherein the handle is injection molded onto the contact protector.

42. The electrical connector of claim 38, wherein the pull portion is an adhesive element.

43. The electrical connector of claim 42, wherein the adhesive element is adhesive tape.

44. The electrical connector of claim 36, wherein the mating side of the contact protector mimics the mating interface of the electrical device.

45. The electrical connector of claim 44, wherein the electrical device is an electrical connector.

46. The electrical connector of claim 44, wherein the electrical device is a substrate.

* * * * *

UNITED STATES PATENT AND TRADEMARK OFFICE

CERTIFICATE OF CORRECTION

PATENT NO. : 7,278,856 B2
APPLICATION NO. : 11/201437
DATED : October 9, 2007
INVENTOR(S) : Steven E. Minich It is certified that error appears in the above-identified patent and that said Letters Patent is hereby corrected as shown below:

Col. 7, line 66, delete second occurrence of "when the"

Col. 8, line 4, delete second occurrence of "when the"

Col. 8, lines 28-29, delete second occurrence of "when the"

Col. 8, line 34, delete "when the"

Signed and Sealed this

Seventeenth Day of June, 2008

JON W. DUDAS
*Director of the United States Patent and Trademark Office*

UNITED STATES PATENT AND TRADEMARK OFFICE

CERTIFICATE OF CORRECTION

PATENT NO. : 7,278,856 B2
APPLICATION NO. : 11/201437
DATED : October 9, 2007
INVENTOR(S) : Steven E. Minich It is certified that error appears in the above-identified patent and that said Letters Patent is hereby corrected as shown below:

COL. 7, line 10, delete second occurrence of "when the"

COL. 7, line 15-16, delete second occurrence of "when the"

Signed and Sealed this

Fifth Day of August, 2008

JON W. DUDAS
*Director of the United States Patent and Trademark Office*